United States Patent [19]

Habiger

[11] 4,343,152

[45] Aug. 10, 1982

[54] LOAD SENSING PORTING ARRANGEMENT

[75] Inventor: Cyril W. Habiger, Joliet, Ill.

[73] Assignee: Caterpillar Tractor Co., Peoria, Ill.

[21] Appl. No.: 245,230

[22] PCT Filed: May 16, 1980

[86] PCT No.: PCT/US80/00579

§ 371 Date: May 16, 1980

§ 102(e) Date: May 16, 1980

[87] PCT Pub. No.: WO81/03362

PCT Pub. Date: Nov. 26, 1981

[51] Int. Cl.[3] ..... F04B 49/08; F15B 13/04

[52] U.S. Cl. ..... 60/452; 91/446; 137/596.13

[58] Field of Search ..... 60/452; 91/446; 137/117, 596.13

[56] References Cited

U.S. PATENT DOCUMENTS

| | | | |
|---|---|---|---|
| 2,941,547 | 6/1960 | Rood | 137/596.13 |
| 3,401,521 | 9/1968 | Plate | 60/452 X |
| 3,592,216 | 7/1971 | McMillen | 91/448 X |
| 3,602,243 | 8/1971 | Holt et al. | 91/446 X |
| 3,707,988 | 1/1973 | Hodgson | 137/596.12 |
| 3,858,393 | 1/1975 | Budzich | 60/484 X |
| 4,030,522 | 6/1977 | Heiser | 137/596.13 |
| 4,129,987 | 12/1978 | Blume | 60/445 |

*Primary Examiner*—Irwin C. Cohen

*Attorney, Agent, or Firm*—Phillips, Moore, Weissenberger, Lempio & Majestic

[57] ABSTRACT

Fluid control circuits employed on construction vehicles to control the actuation of various work cylinders oftentimes include a system for sensing the fluid pressure in the cylinder and communicating such fluid pressure to a control device in signal form to closely control the displacement of a pump, the flow capacity of a pressure compensated flow control valve, or the like. The sensing system is normally associated with the spool of a directional control valve which must travel a substantial distance to effect extension or retraction of the cylinder and normally requires an "anti-rotation" device to insure proper alignment of the various ports and passages. Conventional high pressure systems of this type also pose potential leakage problems.

This invention overcomes such problems by providing an improved load sensing system (45) including an annular land (32) defined on a spool (26) of a control valve (23) and an annulus (46) disposed axially between first (36) and second (37) outlets of the control valve (23) and further disposed to circumvent the land (32) of the spool (26).

9 Claims, 1 Drawing Figure

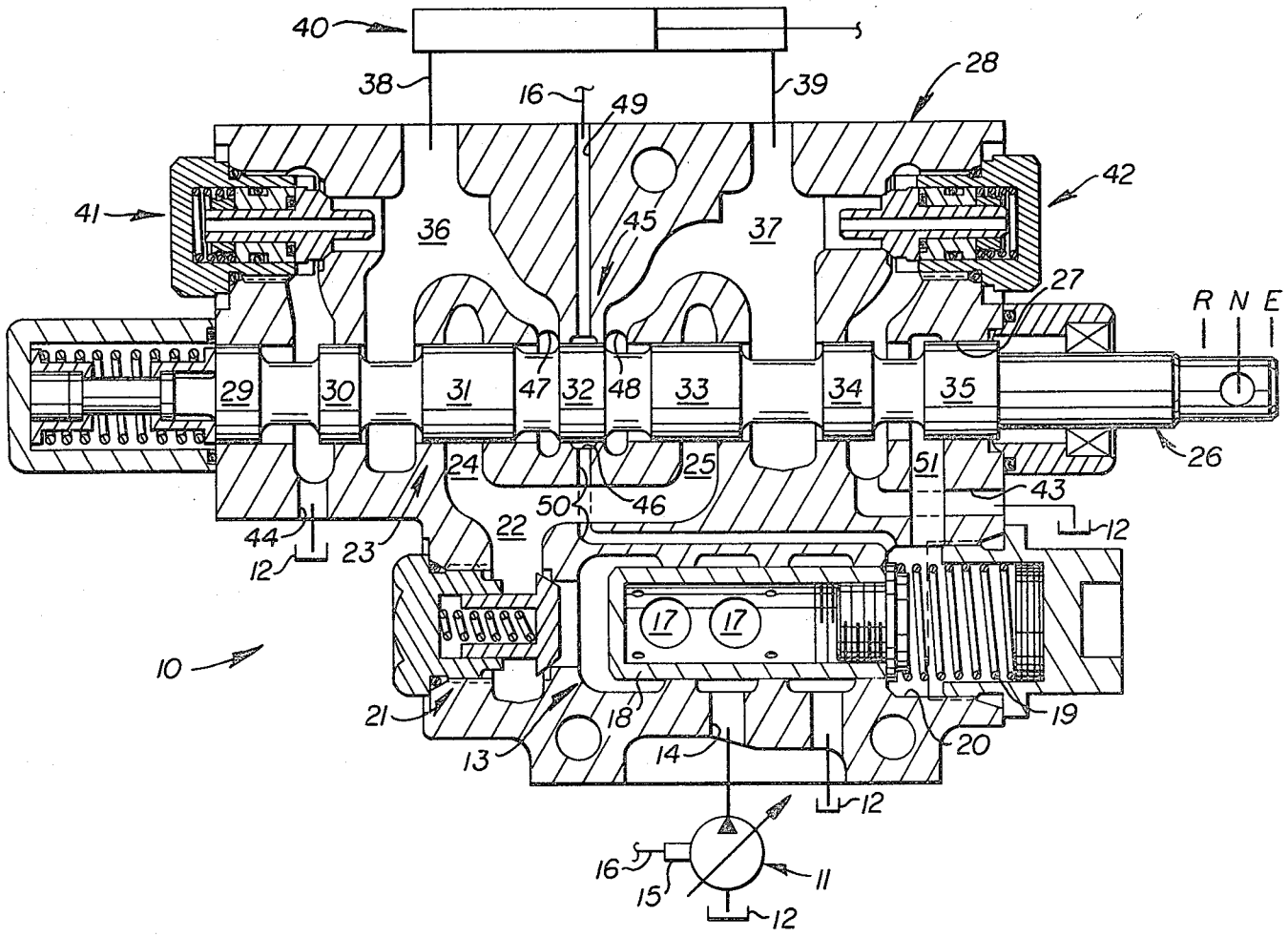
R N E
26
42
27
28
12
43
19
35
51
20
34
39
37
12
11
33
25
17
17
14
12
15
16
45
46
18
49
48
32
50
16
47
22
13
31
24
36
21
38
23
40
30
44
12
29
10
41

LOAD SENSING PORTING ARRANGEMENT

TECHNICAL FIELD

This invention relates generally to means for sensing the fluid pressure in an actuator and more particularly to a porting arrangement employed with a control valve for selectively communicating a fluid control signal to a servo-system of a hydraulic pump, a pressure compensated flow control valve, or the like.

BACKGROUND ART

Various systems have been proposed for sensing the fluid pressure in a fluid actuator, such as a double-acting hydraulic cylinder, and communicating such fluid pressure in the form of a control signal to a device for controlling operation of a servo-system of a hydraulic pump, a pressure-compensated flow control valve, and/or the like. In systems wherein a spool-type control valve is employed to effect such fluid signal, the spool must normally move a substantial linear distance which poses packaging as well as leakage problems.

The leakage problem is aggravated in high pressure systems wherein two or more ports are uncovered simultaneously. In addition, such ports generally do not circumvent the valve spool whereby fluid forces are not equally distributed therearound, thus necessitating the use of means to restrain rotation of the spool to effect the desired sensing function. Other systems of this type employed resolver or check valves which tend to complicate the system and also require close calibration.

The present invention is directed to overcoming one or more of the problems as set forth above.

DISCLOSURE OF INVENTION

In one aspect of the present invention, a fluid circuit comprises a pump, a fluid actuator, a control valve having an inlet and first and second outlets, and a reciprocal spool. An improved load sensing means is employed with the control valve for sensing fluid pressure in the first or second outlet and comprises an annular land defined on the spool and an annulus disposed axially between the first and second outlets and further disposed in circumventing relationship relative to the land when the spool is maintained in its neutral position of operation.

The improved load sensing means of this invention is adapted to be activated with a minimal amount of valve spool travel and minimizes high pressure leakage paths. In addition, equal distribution of pressure forces about the spool by the annulus of the load sensing means eliminates the need for any device to restrain rotation of the spool which could adversely affect proper sensing of the fluid signal.

BRIEF DESCRIPTION OF THE DRAWING

Other objects and advantages of this invention will become apparent from the following description and accompanying drawing which illustrates a fluid circuit, including a cross-sectional view of a control valve having an improved load sensing means embodiment of the present invention associated therewith.

BEST MODE OF CARRYING OUT THE INVENTION

The drawing illustrates a fluid circuit 10 comprising a pump 11 for communicating pressurized fluid from a tank 12 to a pressure-compensated flow control valve

13, via an inlet port 14. The displacement of pump 11 may be controlled by a standard servo-system 15 operatively connected therewith to be controlled by a fluid signal in a line 16 in a conventional manner. Pressurized fluid communicated to valve 13 from inlet port 14 will pass through a plurality of ports 17, defined in a piston 18 thereof, to urge the piston rightwardly against the opposing force of a compression coil spring 19. As explained more fully hereinafter, a chamber 20 containing spring 19 is adapted to have a fluid signal communicated thereto to control the position of piston 18 and the quantity of fluid flow passing through valve 13 and a check valve 21.

Fluid flow through check valve 21 will pass into an inlet 22 of a directional control valve 23 with inlet 22 branching out into first and second inlets 24 and 25, respectively. Control valve 23 further includes a spool 26 reciprocally mounted in a bore 27, defined in a housing 28, for sequential movement between first (R), second (N), and third (E) positions. Spool 26 is normally maintained in its illustrated second or neutral position (N) by the illustrated standard centering mechanism.

Spool 26 has a plurality of lands 29–35 formed thereon with lands 31 and 33 blocking communication of inlet 22 with first and second outlets 36 and 37, respectively, when spool 26 is maintained in its illustrated neutral position of operation. A pair of lines 38 and 39 connect outlets 36 and 37 to the head and rod ends of a fluid actuator 40, shown in the form of a double-acting hydraulic cylinder. A pair of standard make-up valves 41 and 42 are operatively interconnected between tank 12 and cylinder 40 to provide the cylinder with make-up fluid whenever the cylinder attempts to move at a rate faster than enables it to be supplied with pressurized fluid from pump 11.

It can be seen in the drawing that rightward movement of spool 26 to position "E" will effect extension of cylinder 40 by communicating first inlet passage 24 with first outlet passage 36 while simultaneously exhausting the rod end of the cylinder by communicating second outlet passage 37 with a drain passage 43, upon opening of lands 31 and 34 of the spool. Likewise, leftward movement of spool 26 to its position "R" will function to retract cylinder 40 by communicating pressurized fluid from second inlet passage 25 to second outlet passage 37 and past land 33 and to exhaust the head end of the cylinder via first outlet passage 36 and a drain passage 44. It can be further seen that lands 29–31 and 33–35 cooperate with the various ports and passages shown in the drawing to effect the above extension and retraction of cylinder 40.

This invention is primarily directed to an improved load sensing means 45 for sensing fluid pressure in either first outlet 36 or second outlet 37 when spool 26 is in its "E" position or in its "R" position, respectively. It is common practice in the art to sense cylinder pressure and to communicate a fluid signal to a supply pump, such as pump 11, a flow control valve, such as valve 13, or other control devices employed in a fluid circuit which is adapted to control fluid flow or pressure.

Load sensing means 45 comprises annular land 32, defined centrally on spool 26, and an annulus 46, defined centrally in housing 28 and within bore 27. Annulus 46 is disposed axially between a pair of outlet annuli 47 and 48 which form part of outlet passages 36 and 37, respectively. Annulus 46 circumvents land 32 to equally distribute fluid pressure forces about spool 26 to eliminate the need for any device restraining the spool against rotation whereby proper sensing of the fluid signal may be effected.

It should be further noted that only a relatively short travel of spool 26 is required to communicate annulus 46 with either outlet passage 36 or 37. This arrangement further minimizes high pressure leakage paths in the system in contrast to many conventional systems of this general type.

In the embodiment illustrated, the fluid signal in either outlet passage 36 or 37, reflecting the fluid pressure in the head and rod ends of cylinder 40, respectively, may be communicated to a first signal passage 49 which is connected to servo-system of pump 11 via common line 16. As mentioned above, servo-system 15 functions to control the displacement of pump 11 in a conventional manner in response to the fluid signal communicated thereto from signal passage 49. In addition, a second signal passage 50 may be defined in housing 28 to also communicate the same fluid signal to chamber 20 of flow control valve 13 to control the degree of opening thereof and, thus, pump flow thereby. A passage 51 communicates chamber 20 with drain passage 43 when spool 26 is in its neutral position, thus venting the load signal in passage 50 and annulus 46. It should be obvious to those skilled in the arts relating thereto that the fluid signal generated at load sensing means 45 could be utilized to control the actuation of other types of flow control valves, relief valves, and the like.

INDUSTRIAL APPLICABILITY

Fluid circuit 10 finds particular application to construction vehicles wherein a plurality of cylinders 40 are utilized to perform various job tasks. For example, a pair of lift cylinders 40 could be employed on a wheel loader to selectively raise or lower the lift arms thereof. It should be understood that in applications wherein a plurality of cylinders are actuated simultaneously, that a separate valving arrangement of the type illustrated in the drawing would be employed with each cylinder and that such valving arrangements would be interconnected in a conventional manner.

In operation, pressurization of inlet 14 with fluid from pump 11 will function to pressurize inlet passage 22 via flow control valve 13 and check valve 21. Pressurized fluid initially flowing through a leftwardly positioned and partially restricted port 17, formed in piston 18, will create a pressure buildup on the left side of the piston to urge it rightwardly against the opposed biasing force of coil spring 19 to open valve 13 to tank 12. Should the operator desire to extend cylinder 40, he will move valve spool 26 rightwardly to position "E" to communicate branch inlet passage 24 with first outlet passage 36 whereby pressurized fluid will be communicated to the head end of the cylinder via line 38. Simultaneously therewith, land 34 will uncover vent passage 43 to vent the rod end of cylinder 40 via line 39, second outlet passage 37, and vent passage 43.

Such rightward movement of spool 26 will move land 32 thereof rightwardly to uncover annulus 46 and to communicate it with annulus 47 and the fluid pressure prevalent in the head end of cylinder 40. Such fluid pressure will be thus communicated to signal passages 49 and 50 in the form of a fluid control signal. As described above, signal line 49 communicates with servo-system 15 via line 16 to control the displacement of pump 11 in response to the level of fluid pressure in signal passage 49. Also, such fluid pressure will be communicated to modulating chamber 20 of pressure compensated flow control valve 13 to counteract pump pressure at the left end of flow control valve 13 whereby the quantity of pump flow may be closely regulated.

Should the operator now desire to retract cylinder 40, he will shift spool 26 leftwardly to position "R". Land 33 will uncover branch inlet passage 25 to communicate it with second outlet passage 37 to pressurize the rod end of the cylinder. Simultaneously therewith, the head end of cylinder 40 will be vented via line 38, first outlet passage 36, and exhaust passage 44 which is uncovered by land 30. During the retraction phase of cylinder operation, the level of pressurized fluid in the rod end of the cylinder will be communicated to signal passages 49 and 50 to control the displacement of pump 11 and to modulate flow control valve 13 in the manner described above.

Other aspects, objects, and advantages of this invention can be obtained from a study of the drawing, the disclosure, and the appended claims.

I claim:

1. In a fluid circuit (10) having a pump (11), a fluid actuator (40), a control valve (23) having a housing (28) with a bore (27) defined therein, and including an inlet (22) in communication with said bore (27) and connected to said pump (11), first (36) and second (37) outlets in communication with said bore (27) and connected to said actuator (40), spool means (26) in said bore (27) and being sequentially movable between a first position (R) communicating said inlet (22) with said first outlet (36), a second position (N) blocking communication of said inlet (22) with each of said first (36) and second (37) outlets, and a third position (E) communicating said inlet (22) with said second outlet (37), load sensing means (45) for sensing fluid pressure in said first (36) and second (37) outlets when said spool means (26) is in its first (R) and third (E) positions, respectively, and control means (13,15) for being controlled in response to the magnitude of fluid pressure sensed by said load sensing means (45), the improvement comprising:

said load sensing means (45) including an annular land (32) defined on said spool means (26) and engaging said bore (26), and a single annulus (46) disposed in said housing (28) axially between said directly adjacent to said first (36) and second (37) outlets and being of lesser width than the width of said annular land (32), said annulus (46) opening to said bore (27) and circumventing said land (32) to block communication with said first (36) and second (37) outlets when said spool means (26) is in its second position (N) and communicating with said first (36) or second (37) outlet when said spool means (26) is in its first (R) or third (E) position, respectively, and passage means (16) for communicating fluid pressure from said annulus (46) to said control means (15).

2. The fluid circuit (10) of claim 1 wherein said control means (15) includes a servo-system for controlling displacement of said pump (11).

3. The fluid circuit (10) of claim 1 wherein said control means (13) includes a pressure compensating flow control valve (13) interconnected between said pump (11) and said inlet (22).

4. The fluid circuit (10) of claim 1 wherein each of said first (36) and second (37) outlets terminates at an annulus (47,48) positioned closely adjacent to said land

(32) and further positioned in circumventing relationship about said spool means (26).

5. The fluid circuit (10) of claim 1 wherein said fluid actuator (40) comprises a double-acting hydraulic cylinder (40).

6. In a control valve (23) having an inlet (22), first (36) and second (37) outlets, a housing (28), and a spool (26) reciprocally mounted in said housing (28) for movement between a first (R) position communicating said inlet (22) with said first outlet (36), a second (N) position blocking communication of said inlet (22) with each of said first (36) and second (37) outlets, and a third (E) position communicating said inlet (22) with said second outlet (37), the improvement comprising:

a load sensor (45) including an annular land (32) defined on said spool (26) and engaging a wall (27) of said housing (28), a single annulus (46) defined in said housing (28) opening on said wall (27) of said housing (28) and axially between and directly adjacent to said first (36) and second (37) outlets and being of lesser width than the width of said annular land (32) and positioned in circumventing relationship about said land (32) when said spool (26) is in its second (N) position to block communication with said first (36) or second (37) outlets, and communicating with said first (36) or second (37) outlet when said spool (26) is in its first (R) or third (E) position, respectively, and at least one signal passage (49 or 50) defined in said housing (28) and communicating with said annulus (46).

7. The control valve (23) of claim 6 wherein a pair of said signal passages (49,50) are defined in said housing (28) and are open to said annulus (46).

8. The control valve (23) of claim 6 wherein each of said first (36) and second (37) outlets terminates at an annulus (47,48) disposed closely adjacent to said land (32) and further disposed in circumventing relationship about said spool (26).

9. The control valve (23) of claim 7 wherein said signal passages (49,50) are diametrically opposed to each other.

* * * * *